US008726605B2

(12) United States Patent
Davis et al.

(10) Patent No.: US 8,726,605 B2
(45) **Date of Patent: *May 20, 2014**

(54) END WALL PANEL

(71) Applicant: King Solomon Creative Enterprises Corp., McKees Rocks, PA (US)

(72) Inventors: Arnold A. Davis, Pittsburgh, PA (US); Gary J. Bonacci, Burgettstown, PA (US); Sara E. Ohler-Schmitz, Moon Township, PA (US); George Abdel-Sayed, Bloomfield Hills, MI (US); Matt Helgeson, Allison Park, PA (US)

(73) Assignee: King Solomon Creative Enterprises Corp., McKees Rocks, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/828,880

(22) Filed: Mar. 14, 2013

(65) Prior Publication Data

US 2013/0232906 A1 Sep. 12, 2013

Related U.S. Application Data

(63) Continuation of application No. 12/609,218, filed on Oct. 30, 2009, now Pat. No. 8,418,424.

(60) Provisional application No. 61/117,631, filed on Nov. 25, 2008.

(51) Int. Cl.
*E04C 2/32* (2006.01)

(52) U.S. Cl.
CPC .. *E04C 2/32* (2013.01); *E04C 2/322* (2013.01)
USPC ..... 52/630; 52/537

(58) Field of Classification Search
CPC ..... E04C 2/32; E04C 2/322
USPC ..... 52/630, 537, 783.11, 798.11, 86
See application file for complete search history.

(56) References Cited

U.S. PATENT DOCUMENTS

| | | | | | |
|---|---|---|---|---|---|
| 1,784,777 | A * | 12/1930 | Beaujean | 405/279 |
| 2,873,008 | A * | 2/1959 | Ashman | 52/579 |
| 3,097,494 | A * | 7/1963 | Chapron | 405/153 |
| 3,218,773 | A * | 11/1965 | Heirich | 52/521 |
| 3,308,596 | A * | 3/1967 | Cooper et al. | 52/630 |
| 3,968,603 | A * | 7/1976 | Merson | 52/86 |
| 4,358,916 | A * | 11/1982 | Lacasse | 52/630 |
| 5,233,799 | A * | 8/1993 | Abukawa | 52/86 |
| 5,385,423 | A * | 1/1995 | Abukawa | 403/245 |
| 8,418,424 | B2 * | 4/2013 | Davis et al. | 52/630 |

* cited by examiner

*Primary Examiner* — Basil Katcheves
(74) *Attorney, Agent, or Firm* — Fish & Richardson P.C.

(57) ABSTRACT

An end wall panel for an arch-style steel building is disclosed. The end wall panel is fabricated from metal sheet and consists of a plurality of upper flanges spaced apart from one another. The upper flanges are connected to lower flanges by a web section extending at an angle from the upper flange. Flange stiffeners also extend at an angle from the outermost upper flanges. The end wall panel provides increased strength in an arch-style steel building and can withstand critical wind loads without additional stiffeners. The end wall panel is also inexpensive to manufacture and install into an arch-style steel building.

6 Claims, 4 Drawing Sheets

(Prior Art Panel)

END WALL PANEL

TECHNICAL FIELD

The present invention generally relates to a structural panel used in metal buildings, and more specifically to an end wall panel used in construction of arch-style steel buildings.

BACKGROUND

An end wall panel is commonly a component of an arch-style steel building. Arch-style steel buildings are generally formed of three primary cold-formed steel components: the arch panels, which make up the basic shell of the structure; the end walls, which close in the front and rear of the structure; and the curved angle assembly, which serves as the attachment-point for the front and rear end wall to connect to the arch panels. All connections throughout this particular type of building system are usually accomplished by standard sized nuts and bolts.

In order to fabricate an arch-style steel building that is suitable for installation in locations that often experience high wind speeds (i.e. wind speeds in excess of 90 mph) without an internal framework, the end wall panel of the building must be light-weight and able to withstand high shear and bending loads. A problem associated with arch-style steel buildings is that the end wall panels currently used in such buildings do not offer sufficient strength for high-wind applications unless an interior framework is in place behind the panels. Further, the present panels are expensive to manufacture and have a low strength to weight ratio.

The end wall panel design currently used in many arch-style steel buildings, depicted in FIG. 1, is formed from a sheet of metal and consists of two upper flanges spaced apart from one another. Web sections, which act as stiffeners, extend from the two upper flanges at an angle to a lower flange. The "coverage dimension" of a panel (such as an end wall panel) refers to the distance between the centerlines of the outermost upper flanges of the panel. The current end wall panel with a coverage dimension of about 1.5 feet and 2 web sections, has a low moment of inertia and cannot withstand high wind loads. Also, the angle between the upper flange and the web section is generally about thirty-two degrees, which does not meet the American Iron and Steel Institute (AISI), North American Specification for the Design of Cold-Formed Steel Structural Members (NASPEC) 2001 Section B4.2. AISI NASPEC 2001 Section B4.2 defines the acceptable design dimensions for a flange stiffener used in cold-formed steel structures. Consequently, in order to comply with building codes, manufacturers are often required to supply an interior framework for installation behind the end wall panels in arch style steel buildings that are to be erected in locations in which they will be exposed to winds in excess of 90 mph.

In addition, the end wall panel design currently employed in many arch style steel buildings is costly and difficult to manufacture. The present panel is made from a single sheet of metal, has a coverage of 1.5 feet in width and may be up to 191 inches in length (the length of the stock sheet panel) depending on the dimensions of the building. The total flat width of the sheet metal panel (i.e. the width prior to bending) required to create an end wall panel with 1.5 feet of coverage is 23 inches. The metal sheet used to create the panel is cut from a coil of sheet metal. A coil of sheet metal 23 inches wide, which is relatively narrow in width, is costly to manufacture because narrower and thinner coils of sheet metal are more expensive than wider and thicker coils. As such, the most cost effective way to create a 23 inch wide metal sheet is to slit a 46.5 inch wide coil of sheet metal in half. Slitting such a sheet metal coil in half requires outside processing and adds additional steps to the manufacturing process. Also, some material is lost every time a steel panel is slit or cut. A 33 inch wide coil is used to fabricate the arch panels commonly used in steel buildings. In order to reduce costs, it be would desirable to fabricate the end wall panel from a standard size 33 inch wide coil, which is less expensive than cutting a 46.5 inch coil in half. As such, an arch-style metal building manufacturer would only have to purchase a single coil size (33 inch wide) to fabricate the primary components of an arch-style steel building.

Another drawback of current end wall panels is their "coverage dimension." Current end wall panels customarily have a coverage dimension of about 1.5 feet. This makes installation of the end wall panel into many standard sized arch-style steel buildings expensive and difficult. The difficulty arises from the size of industry standard entryways. Many standard end wall entryway (e.g. door) sizes do not correspond to the one and one-half feet coverage dimension of the commonly used end wall panel. Thus, filler panels must be installed to enable a flush fit for the entryway enclosure. For example, if a cutout is ten feet wide, six one and one-half feet wide end wall panels will cover nine feet of the end wall width above the cutout. This will not accommodate a standard size closure. When the closure is installed, a one foot gap will remain above the cutout, and a one foot wide filler panel must be fabricated and installed to fill in the gap. Fabricating and installing a custom sized filler panel increases the production cost of the building. In addition, the filler panels detract from the aesthetic quality of the arch-style steel building.

In the past, there have been several attempts to provide light-weight structural panels for steel buildings. One such building panel is disclosed in U.S. Pat. No. 2,873,008 of Ashman. The Ashman structural panels are fabricated from metal sheet and have a corrugated section (element 5 on Ashman FIGS. 1 and 2) and a wing section (element 6 on Ashman FIGS. 1 and 2). The corrugated section consists of a plurality of troughs of equal depth. The wing section is a flange extending from the outer side of an outermost trough of the corrugated section. The Ashman panel would likely require additional framework installed behind the panels to meet high-wind requirements. The wing section also increases the amount of material required to fabricate a building resulting in a low strength to weight ratio.

U.S. Pat. No. 3,968,603 of Merson discloses a panel for prefabricated metal buildings. Merson discloses a U-shaped corrugated panel comprised of a bottom wall with a plurality of U-shaped ribs. The side walls, which form the outermost edges of the corrugated panel, are longer than the height of the U-shaped ribs of the corrugated panel and have crimped ends. The plurality of U-shaped ribs and side walls add weight to the panel without greatly increasing the panel's strength. As such, the panel has a low strength to weight ratio. In addition, the panels are U-shaped and cannot easily be installed overlapping one another to increase the stiffness of the end wall or arch section of the building.

U.S. Pat. No. 4,358,916 of Lacasse discloses a corrugated metal building structural unit. The structural unit is comprised of one or more longitudinally extending major waves with a plurality of interlinked longitudinally extending wave-like stiffeners superposed on each major wave. Due to the fact that the Lacasse panel has a high density of wave-like stiffeners, the panel requires excess material and has a low strength to weight ratio.

U.S. Pat. No. 3,308,596 of Cooper discloses a panel of one or two major corrugations with minor corrugations on each of the surfaces of the panel. Due to the high level of minor corrugations on each of the surfaces of the panel, the panel requires more material and as a result has a low strength to weight ratio.

It would be desirable to create an end wall panel that has adequate strength for high-wind applications, that would not require an internal framework and that has a higher strength to weight ratio than the prior art end wall panels. It would also be desirable to have an end wall panel that is inexpensive to manufacture and can easily be installed in arch-style steel buildings of varying dimension.

SUMMARY OF THE INVENTION

The present invention overcomes the drawbacks of the prior art structural panels by providing an end wall panel that is easy and inexpensive to manufacture and offers sufficient strength for installation in areas that experience high wind speeds, without the need for an internal frame. The end wall panel of the present invention is less expensive to fabricate because it is made from the same size steel coil as the arch panels used to construct other components of the arch-style building and is easier to assemble into a finished arch-style building compared to the existing structural panels because the width of the new end wall panel corresponds to the dimensions of many standard end wall entryway cutout sizes.

According to one aspect of the present invention, an end wall panel is formed from a metal sheet and includes an odd number of upper flanges spaced apart from one another and at least four web sections that extend at an angle from each side of the upper flanges. The end wall panel of the invention also has multiple lower flanges, each of the flanges being joined to adjacent upper flanges by a web section. In one preferred embodiment, the total number of lower flanges is one less than the number of upper flanges and one lower flange between each pair of adjacent upper flanges. The lower flange sections are generally wider than the upper flange sections.

In one preferred embodiment of the invention, the end wall panel comprises three upper flanges and two lower flanges.

In another embodiment of the invention, the end wall panel is formed from metal sheet and comprises multiple rib units serially arranged adjacent to one another. Each rib unit has an upper flange, a lower flange and a web portion. The web portions extend downward at an angle from each side of the upper flange surface. The lower flanges are each located between adjacent upper flanges and are joined to the adjacent upper flanges by a web portion. Flange stiffeners extend at an angle from the outer edge of the outermost upper flanges and do not extend to a lower flange. The flange stiffeners are shorter in length than the web portions connecting the upper and lower flanges.

In a further embodiment of the invention, the flange stiffeners extending from the outer edge of the outermost upper flanges are less than half the length of the web portions connecting the upper and lower flanges.

In a further embodiment of the invention, the ends of the end wall panel are shaped to match the contour of an arch-style metal building.

In a further embodiment of the invention, the outermost upper flanges of the end wall panel contain multiple holes arranged serially adjacent to one another along the length of the end wall panel.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF PREFERRED EMBODIMENTS

Figure 1:
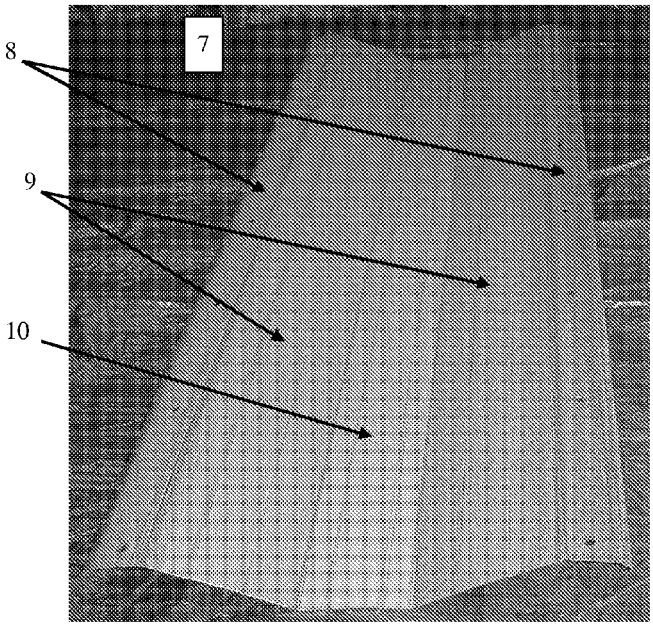
FIG. 1 is a perspective view of the prior art end wall panel used in constructing arch-style steel buildings.

Referring now to FIG. 1, there is shown a representation of the prior art end wall panel 7 that has been previously used in construction of arch-style steel buildings. The end wall panel consists of two upper flanges 8 formed in the panel surface and connected to a lower flange 10 by web sections 9. The upper flanges 8, web section 9, and the lower flange 10 are generally flat surfaces.

Figure 2:
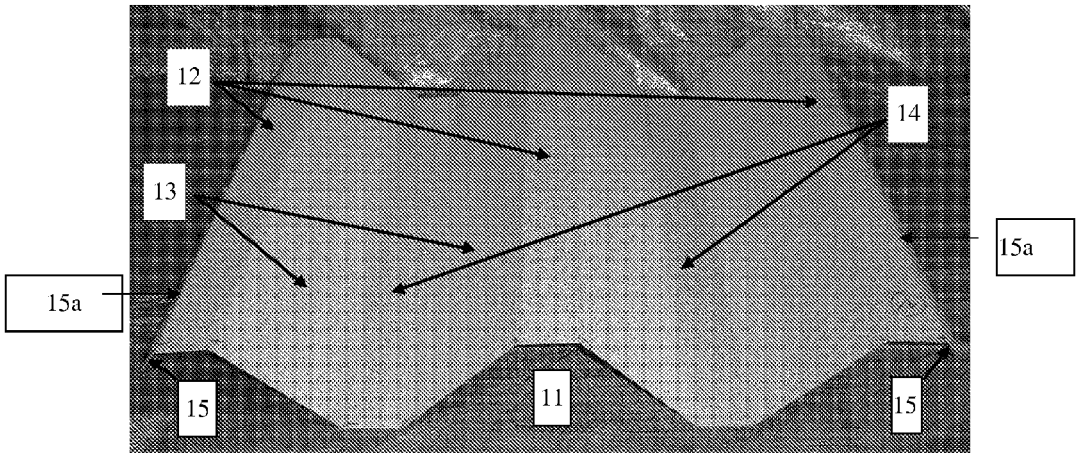
FIG. 2 is a perspective view of the end wall panel in accordance with an embodiment of the present invention.

FIG. 2 depicts an end wall panel 11 in accordance with an embodiment of the present invention. The end wall panel 11 is fabricated from a metal sheet made of steel, aluminum, steel alloys, aluminum alloys, or other ferrous or non-ferrous metals or metal alloys. The flat metal sheet is cut from a coil of rolled sheet metal with a metal slitting machine. Each coil of sheet metal weighs up to 15,000 lbs. It is desirable to limit the number of times a sheet is cut or slit because each cut or slit involves the expense of performing the cutting or slitting operation e.g. the labor cost, and also results in the loss of some material from the sheet. The flat metal sheet cut from the coil is approximately 33 inches wide, up to 191 inches long and between 0.030 to 0.046 inches thick. The flat metal sheet is bent into the shape of the panel on a roll forming line. The roll forming line bends a flat sheet of metal into a desired shape by passing the metal through a series of roller dies. The end wall panel 11 consists of three upper flanges 12 formed in the surface of the panel and joined to lower flanges 14 by web sections 13. The web sections 13 extend downward at an angle from the flat surface of the upper flanges 12. The angle at which the web sections 13 extend downward from the flat surface of the upper flanges 12 is between 41 and 45 degrees, but an angle of 43 degrees is preferred. The flange stiffeners 15 extending from the outer edges of the outermost upper flanges 12 extend at approximately the same angle as the web sections 13 connecting the upper flanges 12 and the lower flanges 14. The flange stiffeners 15 extending from the outer edges of the outermost upper flanges 12 are shorter than web sections 13 connecting the upper flanges 12 and lower flanges 14. The upper flanges 12, web section 13, and the lower flanges 14 are generally flat surfaces. The length of the end wall panel 11 is dictated by the height of the arch-style steel building. FIG. 2 shows one specific embodiment of the invention with three upper flanges 12.

Figure 3:
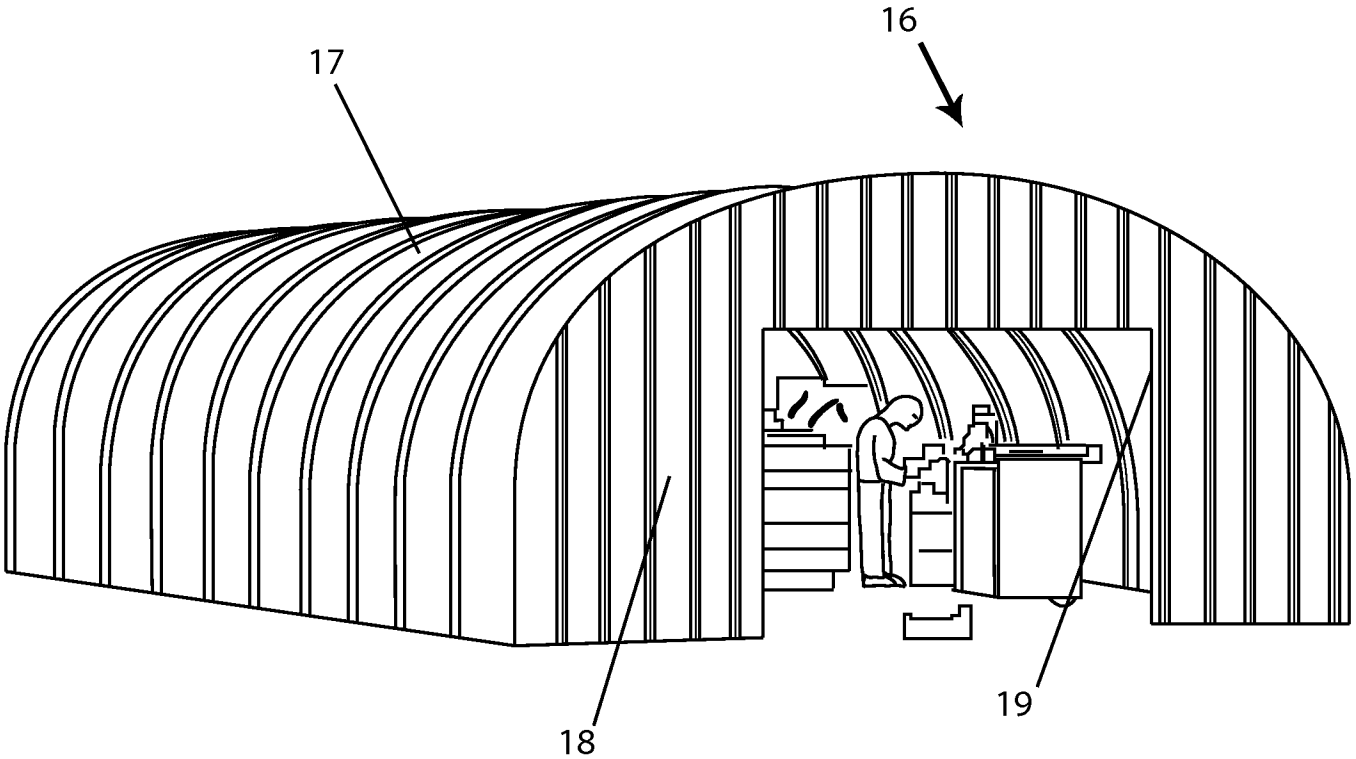
FIG. 3 is an isometric view of a typical arch-style steel building.

Referring now to FIG. 3, there is shown a detail of a typical arch-style steel building 16. The arch-style steel building 16 consists of arch panels 17 connected to end wall panels 18 on the front and rear of the arch-style steel building structure 16. The top edge of each end wall panel 18 is shaped to conform to the contour of the roof of the arch-style steel building 16. As such, the overall length and shape of the top edge of each end wall panel 18 defines the contour of the arch in an arch-style steel building 16. Many arch-style steel buildings also contain a pre-cut entryway 19 in the front and/or rear end wall 18 that may be used for installation of a passage door.

Figure 4:
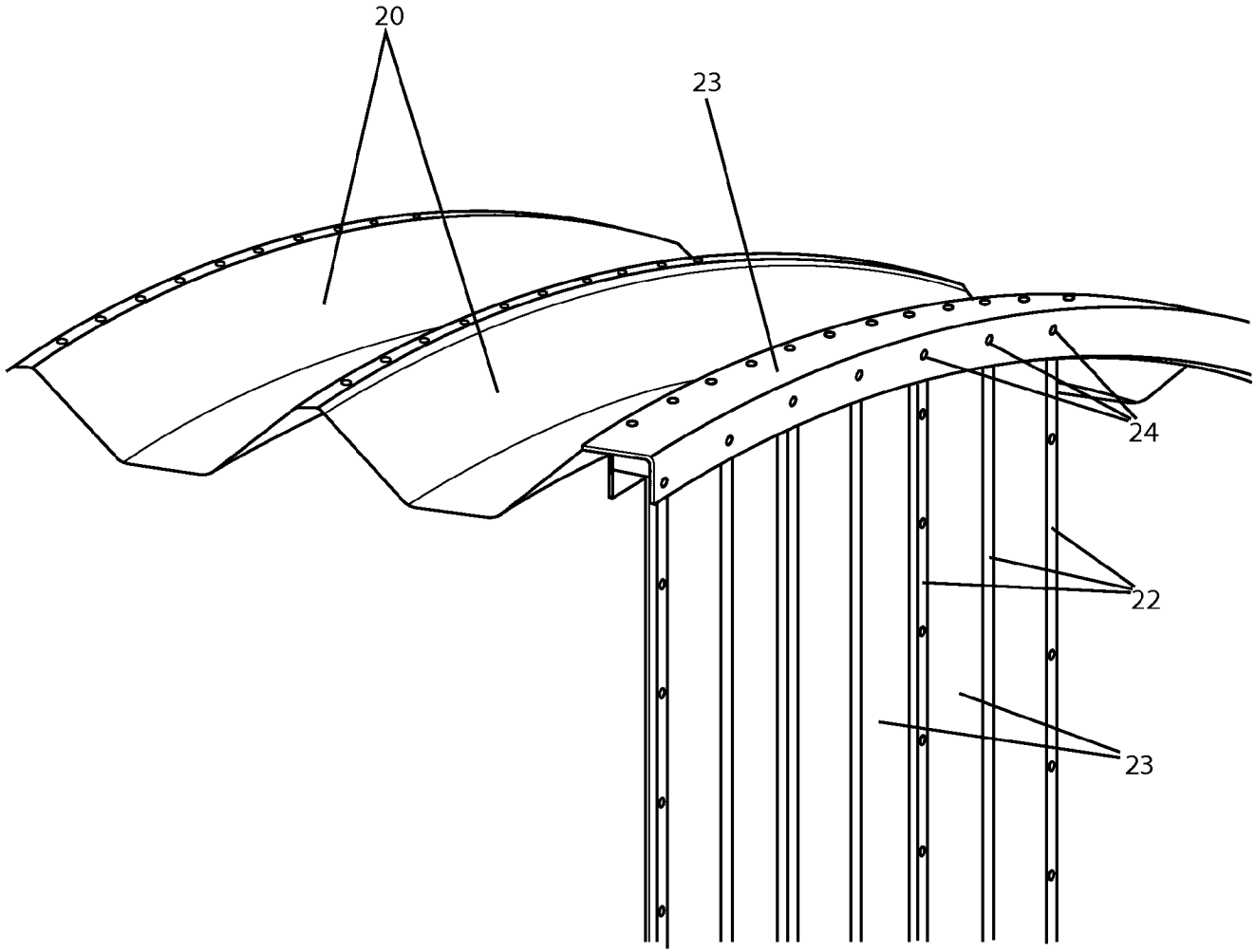
FIG. 4 is an isometric view of the connection between the end wall panels of the present invention and the arch panels of an arch-style steel building.

Referring now to FIG. 4, there is shown an isometric view of the attachment between the end wall panels 21 and the arch panels 20 in an arch-style steel building. The end wall panels 21 are installed with the upper flanges 12 of the panels on the outside of the building. Each end wall panel 21 is fastened to adjacent end wall panels 21 and to arch panels 20 by bolts, nuts and washers commonly used in the industry. The end wall panels 21 are connected to the arch panels 20 using curved metal angles 23. The upper ends of the end wall panels 21, which attach to the curved metal angles 23, are shaped to match the curve of the curved metal angle 23. The curve of the curved metal angle 23 follows the shape of the roof of the arch-style steel building 16. The arch panels 20 and the end wall panels 21 are attached to the curved metal angles 23 with bolts, nuts and washers installed in thru holes 24 in the curved angle 23. In one embodiment of the invention, thru holes 22 are drilled in the outermost flanges of the end wall panel 21. The thru holes 22 are spaced apart from one another at regular intervals and allow for attachment and securing of the panel to adjacent end wall panels 21 and the curved metal angle 23. In one embodiment, the thru holes 22 accommodate bolts and are spaced apart from one another vertically.

Figure 5:
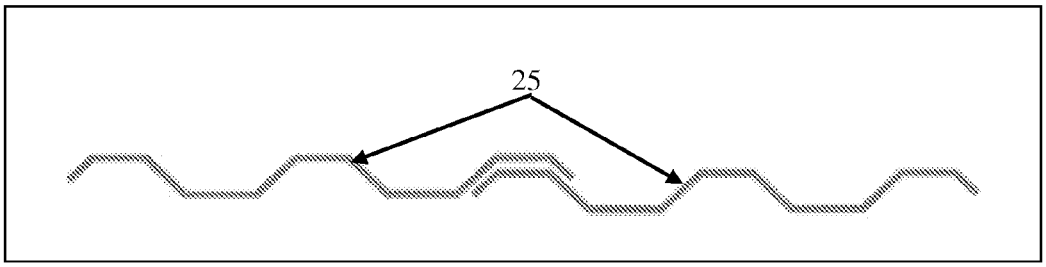
FIG. 5 is a cross-section view of the typical overlap between two end wall panels of the present invention in an assembled arch-style steel building.

Referring now to FIG. 5, there is shown a cross-section view depicting the overlap of two adjacent end wall panels 25 in an assembled arch-style steel building. The end wall panels 25 have one overlapping upper flange 12 and are attached to one another with standard size bolts, nuts and washers that are installed through the thru holes 22 in the upper flanges 12.

Figure 6:
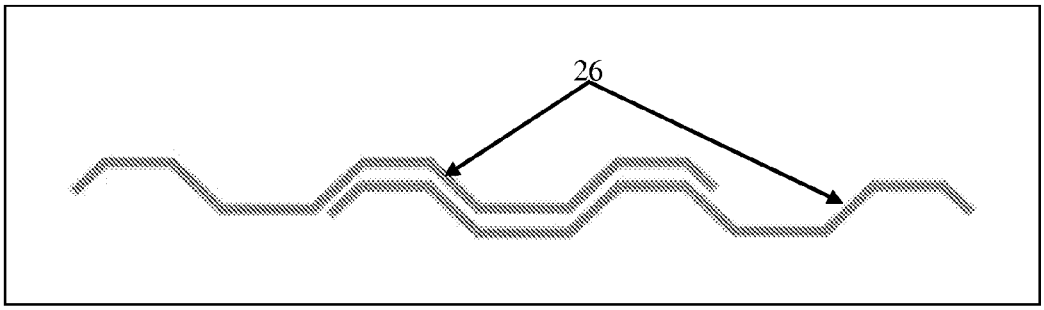
FIG. 6 is a cross-section view of an alternative type of overlap between two end wall panels of the present invention in an assembled arch-style steel building.

Referring now to FIG. 6, there is shown a cross-section view depicting the overlap of two adjacent end wall panels 26 in an assembled arch-style steel building with two overlapping upper flanges 12. When two end wall panels 26 are attached to one another with two overlapping upper flanges 12, the panels are said to be back-lapped. The end wall panels 26 may be back-lapped in order to strengthen the end wall structure or accommodate the overall dimensional requirements of the building. The end wall panels 26 are attached to one another with standard bolts, washers and nuts that are installed through the thru holes 22 in the upper flanges 12.

As depicted in FIG. 2, the flange stiffeners 15 extending from the outer edges of the outermost upper flanges 12 are less than half the length of the web sections 13 connecting the upper flanges 12 and lower flanges 14. The flange stiffeners 15 extending from the outer edges of the outermost upper flanges 12 extend at an angle of 40 to 140 degrees from the surface of the upper flange 12. In a preferred embodiment, the flange stiffeners extend at an angle of approximately 43 degrees from the surface of the upper flange 12. The flange stiffeners 15 extending from the outer edges of the outermost upper flanges 12 increase the moment of inertia and overall stiffness of the end wall panel 11. The outermost flange stiffeners 15 also improve the aesthetic appearance of the end walls 18.

Referring to FIG. 2, the end wall panel 11 consists of an odd number of upper flanges 12. An end wall panel 11 with an odd number of upper flanges 12 can be attached to an adjacent end wall panel 11 with multiple overlapping upper flanges 12, as depicted in FIG. 6. Whereas, the prior art end wall panel 7, which has an even number of upper flanges 8, can only be attached to adjacent end wall panels 7 with one overlapping upper flange 8. Installing the end wall panels 11 of the present invention with multiple overlapping upper flanges 12 increases the stiffness of the end wall as a whole and increases the shear and bending strength of the arch-style steel building. An end wall panel 11 with an odd number of upper flanges 12 can also be attached to adjacent end wall panels 11 with only one overlapping upper flange 12 to meet the dimensional requirements of the building. In addition, the end wall panel 11 with an odd number of upper flanges 12 simplifies installation of the end wall panel 11 because the panel cannot be installed with an upper flange 12 overlapping a lower flange 14. As such, the end wall panels 11 can only be installed with the upper flange or flanges 12 of one end wall panel overlapping the upper flange or flanges 12 of an adjacent end wall panel thereby reducing the possibility for error in the assembly process of an arch-style metal building.

Referring again to FIG. 2, the end wall panel consists of three upper flanges 12. In this embodiment, the distance between the upper flanges 12 and the lower flanges 14 is roughly three and one-half inches, and the coverage dimension is approximately 24 inches. An end wall panel with a twenty-four inch coverage dimension is manufactured using a 33 inch flat metal strip, which is the common width used to make panels for arch-style steel buildings. As such, this embodiment can be fabricated from the same steel coil that is used to make the commonly produced arch panels thereby reducing manufacturing costs and eliminating waste material (i.e. the panel is the same width as the coil stock from which it is formed). Also, the end wall panel with three upper flanges 12 and a coverage of twenty-four inches has 2 web sections 13 every twelve inches, measured between the centerlines of two adjacent upper flanges 12, compared to the prior art end wall panel, which has 2 web sections 13 every 18 inches. The additional web sections 13 increase the moment of inertia of the end wall panel. Additionally, the change in ratio of the upper flanges 12 to lower flanges 14 from 2:1 in the prior art panel 7 to 3:2 in the end wall panel of the present invention 11 moves the moment of inertia closer to the upper flanges 12. As a result, the end wall panel of the present invention can withstand 20% higher positive bending and 50% higher negative bending loads than the prior art end wall panel generally depicted in FIG. 1. The end wall panel of the present invention can also withstand about 70% higher shear loads than the prior art end wall panel. As such, an arch-style steel building with the end wall panels of the present invention can withstand high wind loads without the installation of internal framework behind the panels.

Additionally, the end wall panel consisting of three upper flanges 12, is easier to bend from a flat sheet to its final shape than the prior art end wall panel 7, which has two upper flanges 8. The end wall panel is bent from a flat metal sheet to its final shape using the roll forming process. The more flanges required in a sheet metal part, the easier it is to control during the roll forming process. As such, the additional upper flange 12 and lower flange 14 allow more control during the roll forming process, thereby increasing manufacturing consistency and reducing manufacturing costs.

In addition, an end wall panel that provides twenty-four inches of coverage can be installed surrounding most standard size pre-cut entryways 19 without the use of filler panels. The end wall panels currently used to make arch-style steel buildings have a coverage dimension of 1.5 feet, which results in difficulty in assembling end walls with many standard entryway 19 sizes. The difficulty arises from installation of the end wall panels 18 above an entryway cutout 19 in the end wall. For example, if an entryway 19 cutout is ten feet wide, six one and one-half foot wide end wall panels 7 will cover 9 feet of the end wall width above the entryway 19. This cutout size does not correspond to the size of the standard size closures (e.g. doors) that are widely available and less expensive than custom sized doors. A one foot gap will remain above the door and a one foot wide filler panel must be fabricated and installed to fill in the gap. The end wall panel of the present invention has a coverage dimension of two feet. If an entryway cutout 19 is ten feet wide, five end wall panels of the present invention will cover 10 feet of the width above the door and no filler panels are required. Similarly, if an entryway cutout 19 is 11 feet wide, five end wall panels of the present invention will cover ten feet of the width. One additional end wall panel can be installed with two upper flanges overlapping the upper flanges of the adjacent end wall panel, as depicted in FIG. 6, to cover the remaining one foot of width and no filler panels are required. As such, the end wall panels of the present invention correspond to many standard door sizes and eliminate the need for custom filler panels to be installed thereby reducing construction costs.

In another embodiment of the present invention, the lower flanges 14 are wider than the upper flanges 12. In this embodiment, the lower flanges 14 are two and one-half inches wide while the upper flanges 12 are two inches wide. As such, the ratio of the width of the upper flanges 12 to the lower flanges 14 is 2:2.5. Because the panels are installed with the upper flanges 12 on the outside of the building, the end wall panel of the present invention can withstand higher wind suction loads (which apply their load on the panel towards the outside of the building) than wind pressure loads (which apply load on the panels towards the inside of the building). This is advantageous because wind suction loads are typically higher than wind pressure loads.

The angle between the upper flanges 12 and the web sections 13 is selected based on environmental load requirements and the dimensions of the building. The angle must be between 40 and 140 degrees to comply with the AISI requirement (NASPEC 2001 Section B4.2) for flange stiffeners. Preferably, the angle should be between 41 and 45 degrees to maintain the manufacturability of the design. In one especially preferred embodiment, the web sections 13 extend at an angle of approximately 43 degrees downward from the flat surface of the upper flanges 12. The end wall panel with web sections 13 extending at 43 degrees accommodates installation with arch panels 20 and curved angles 23 commonly used in the arch-style steel building industry.

The end wall panel 11 of the invention may be fabricated from high strength, low alloy sheet steel conforming to American Society of Testing Materials (ASTM) A792-02, Grade 50, Class 2, 50,000 ksi yield strength. The steel thickness in this embodiment ranges from 0.027 inches to 0.046 inches. The panel may also be fabricated from other grades of steel or steel alloys, or from aluminum or aluminum alloys, or from other metals or metal alloys customarily used in construction of metal buildings, including by way of example ASTM A792, Grade 50, Class 1, 50 ksi yield strength stainless steel or carbon steel. The end wall panel may be coated with zinc (galvanized), Galvalume, and/or paint for corrosion protection; however, other forms of corrosion protection such as passivation treatment, enameling, and powder coating may also be employed in manufacturing the end wall panels of the present invention.

The invention claimed is:

1. An end wall panel comprising an inner upper flange, an outer upper flange, and a central upper flange between the inner and outer upper flanges, a first lower flange joining a first web section extending from a first edge of the inner upper flange and a second web section extending from a first edge of the central upper flange, a second lower flange joining a third web section extending from a first edge of the outer upper flange and a fourth web section extending from second edge of the central upper flange, a fifth web section extending at an angle of between 40 to 140 degrees from an outer edge of the inner upper flange, a sixth web section extending at an angle of between 40 to 140 degrees from an outer edge of the outer upper flange, the lower flanges being wider than the upper flanges, all of said web sections extending from their respective upper flanges at an angle of between 41 and 45 degrees measured downward from the surface of the upper flange to which each of the web sections is attached, and wherein the fifth and sixth web sections are shorter than the first, second, third and fourth web sections and the fifth and sixth web sections can partially overlap and conform to the angle of the first or third web section on an adjacent end wall panel, and the ratio of the width of the upper flanges to the width of the lower flanges is about 2:2.5.

2. end wall panels according to claim 1, wherein the ends of the end wall panel are shaped to match the contour of an arch-style building.

3. An end wall panel according to claim 1, wherein the outermost upper flange and the inner upper flange contain multiple holes arranged serially adjacent to one another along the length of the end wall panel.

4. An end wall panel according to claim 1, wherein the panel is formed from a steel or steel alloy metal sheet.

5. An end wall panel according to claim 1, wherein the panel is formed from an aluminum or aluminum alloy metal sheet.

6. An end wall panel according to claim 1, wherein the panel is treated for corrosion protection using a method or methods selected from the group consisting of zinc coating, Galvalume, paint, passivation treatment, enameling and powder coating.

* * * * *